US007648399B1

(12) United States Patent
Lai

(10) Patent No.: US 7,648,399 B1
(45) Date of Patent: Jan. 19, 2010

(54) ALL-IN-ONE CARD CONNECTOR

(75) Inventor: Yaw-Huey Lai, Taipei County (TW)

(73) Assignee: Tai-Sol Electronics Co., Ltd., Taipei (TW)

( * ) Notice: Subject to any disclaimer, the term of this patent is extended or adjusted under 35 U.S.C. 154(b) by 0 days.

(21) Appl. No.: 12/379,136

(22) Filed: Feb. 13, 2009

(30) Foreign Application Priority Data

Jan. 8, 2009 (TW) ..... 98100542 A

(51) Int. Cl.
*H01R 24/00* (2006.01)

(52) U.S. Cl. ..... 439/630

(58) Field of Classification Search ..... 439/630, 439/626, 941, 159, 946
See application file for complete search history.

(56) References Cited

U.S. PATENT DOCUMENTS 6,382,993 B1 5/2002 Chen
7,056,155 B2 * 6/2006 Fan ..... 439/630
7,059,910 B1 * 6/2006 Chang ..... 439/630
7,234,969 B2 * 6/2007 Chang et al. ..... 439/630
7,448,912 B1 * 11/2008 Shiue et al. ..... 439/630

* cited by examiner

*Primary Examiner*—Michael C Zarroli
(74) *Attorney, Agent, or Firm*—Bacon & Thomas, PLLC

(57) ABSTRACT

An all-in-one card connector includes a base frame, a cover member; a first terminal having a plurality of first terminals each having a molding part embedded in the base frame and a rear end thereof partially exposed outside a rear end of the base frame; a bridge piece set having a plurality of bridge pieces having a molding part embedded in the base frame, a front end partially exposed outside the base frame, and a rear end partially exposed outside the rear end of the base frame; and a second terminal set having a plurality of second terminals mounted to a terminal rack mounted to the base frame each having a rear end partially exposed outside the terminal rack and in contact with the front end of the bridge piece.

6 Claims, 5 Drawing Sheets

ALL-IN-ONE CARD CONNECTOR

BACKGROUND OF THE INVENTION

1. Field of the Invention

The present invention relates generally to electronic card connectors, and more particularly, to an all-in-one card connector having multiple terminal sets formed by insert mold.

2. Description of the Related Art

U.S. Pat. No. 6,382,993 disclosed that a number of terminals in a card connector are mounted to a transverse frame by insert mold. There are at least two different terminal sets inside and such different terminal sets may be arranged in a front row and a rear row respectively. However, if the insert mold is applied to both of the two terminal sets of the all-in-one card connector at the same time, it will be very difficult to insert the two terminal sets into the same row of the rear side of the transverse base. For example, the first terminal set may interfere with the second terminal set located behind the first terminal set. In addition, when the two terminal sets are formed by the insert mold, it is not easy to position them because of their interference or proximity.

SUMMARY OF THE INVENTION

The primary objective of the present invention is to provide an all-in-one card connector, to which the insert mold is easily applied without uneasy positioning and easy interference for better positioning and low production cost.

The foregoing objective of the present invention is attained by the all-in-one card connector composed of a base frame, a cover member, a first terminal set, a bridge piece set, and a second terminal set. The cover member is mounted on the base frame. A card chamber is formed between the base frame and the cover member. An entrance is jointly defined by respective front ends of the base frame and the cover member. The first terminal set is formed of a plurality of first terminals, each of which has a molding part embedded in the base frame, a front end thereof extending into the card chamber, and a rear end thereof partially exposed outside a rear end of the base frame. The bridge piece set is formed of a plurality of bridge pieces, each of which is has a molding part embedded in the base frame, a front end thereof partially exposed outside the base frame, and a rear end thereof partially exposed outside the rear end of the base frame. The second terminal set is formed of a plurality of second terminals mounted to a terminal rack mounted to the base frame. Each of front ends of the second terminals extends into the card chamber. Each of rear ends of the second terminals is partially exposed outside a rear end of the terminal rack and in contact with one of the front ends of the bridge pieces.

DETAILED DESCRIPTION OF PREFERRED EMBODIMENTS

Figure 1:
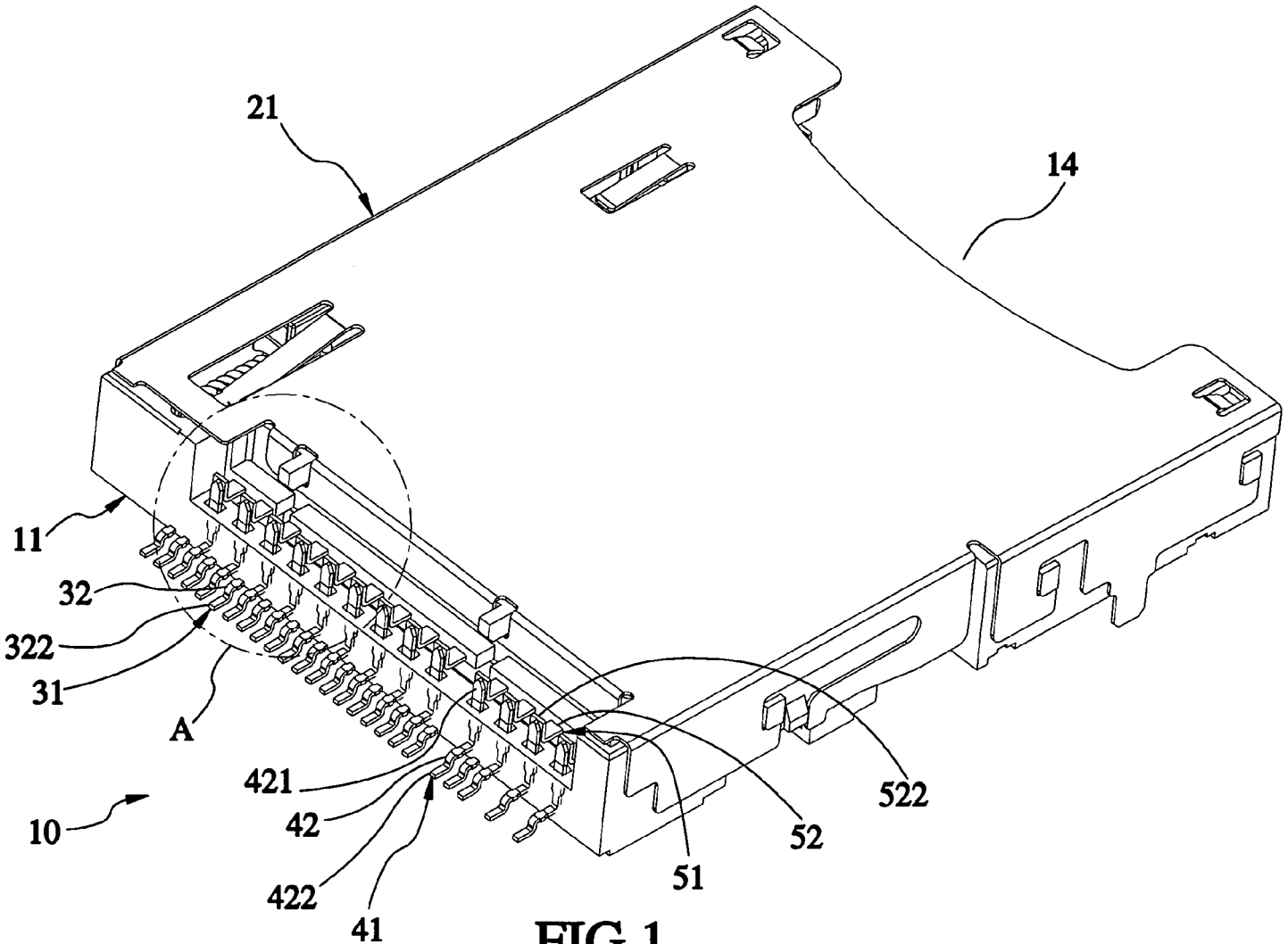
FIG. 1 is a perspective view of a preferred embodiment of the present invention.
Figure 2:
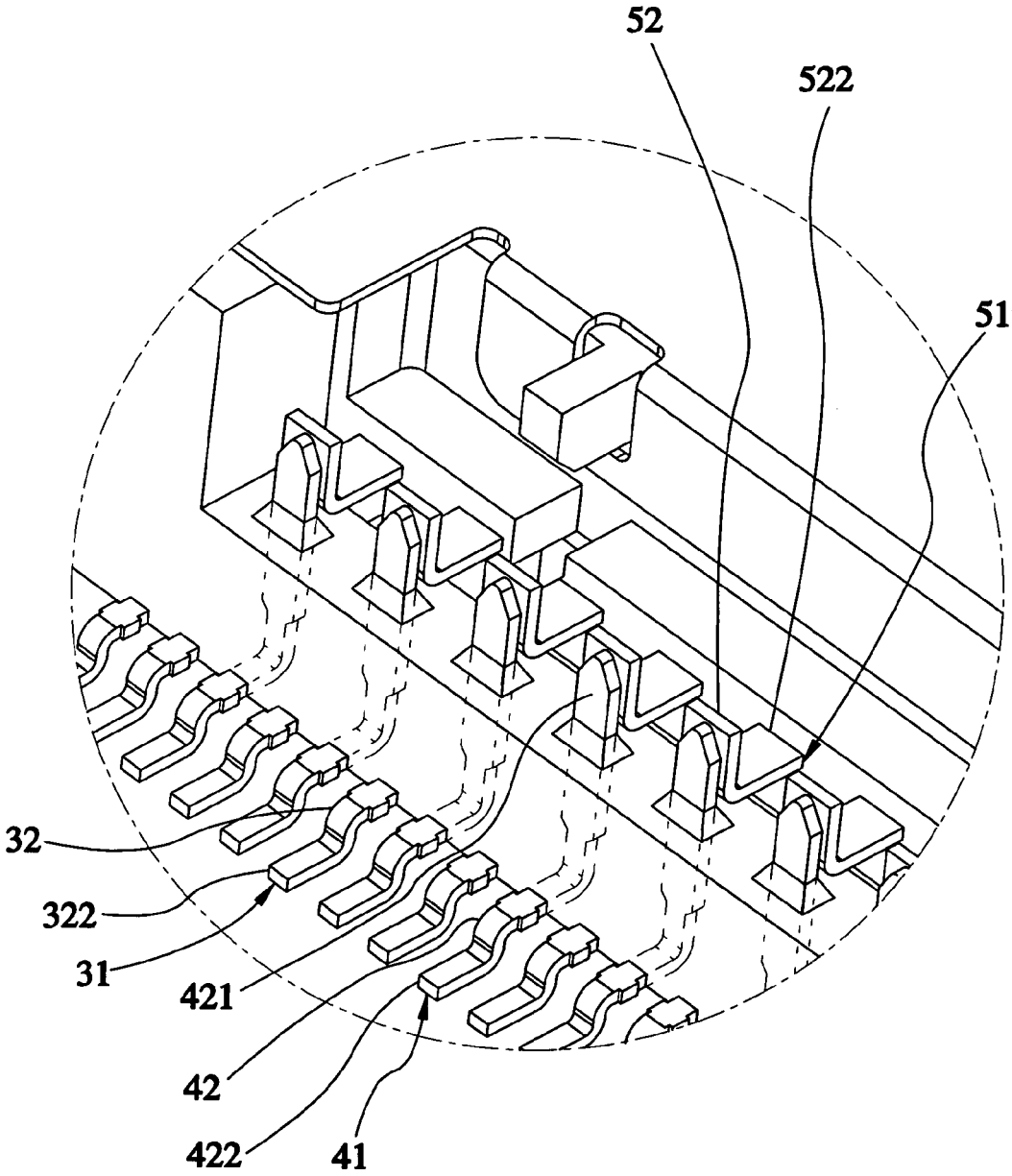
FIG. 2 is an enlarged view taken from a part A indicated in FIG. 1.
Figure 3:
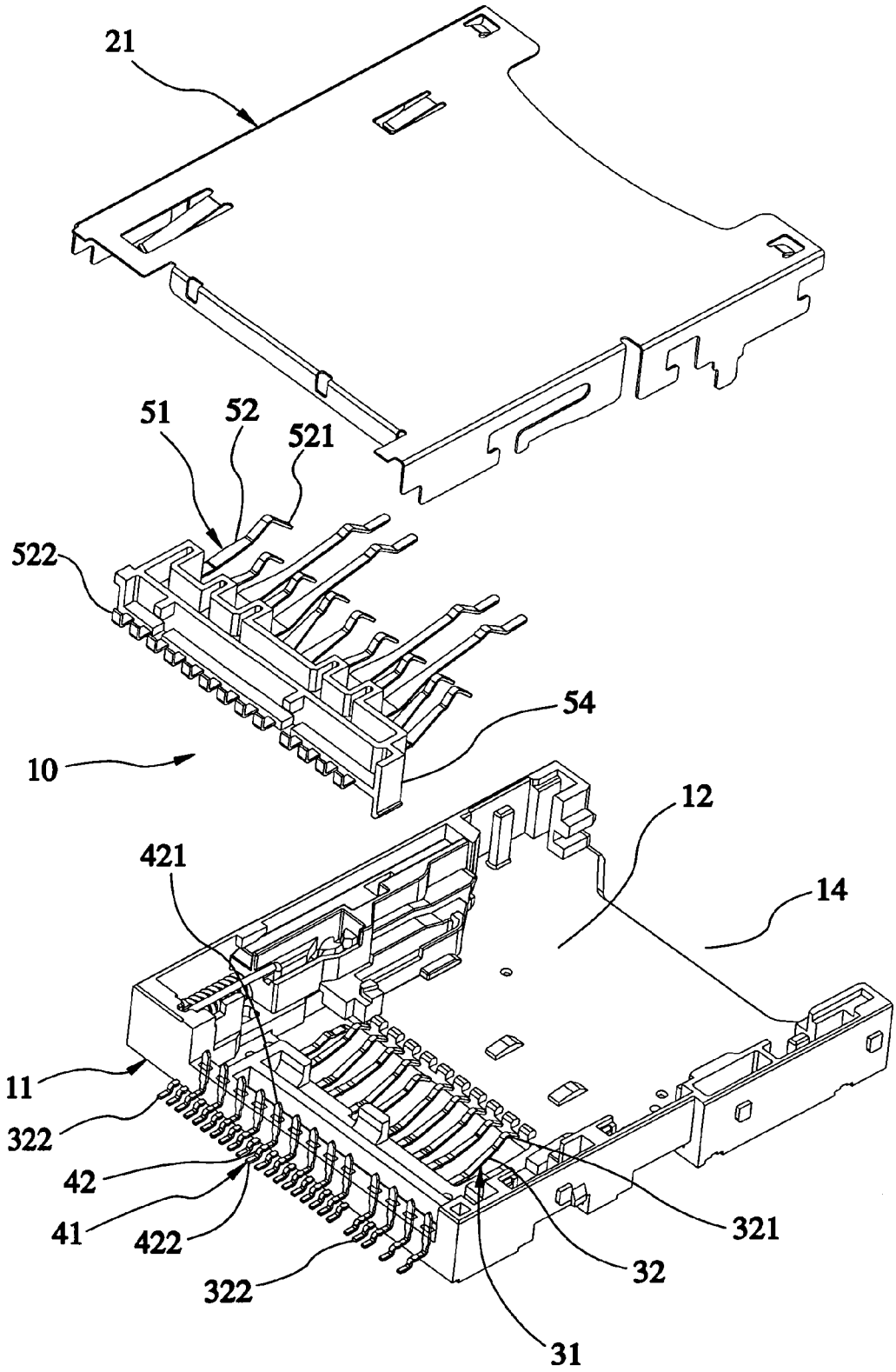
FIG. 3 is an exploded view of the preferred embodiment of the present invention.
Figure 4:
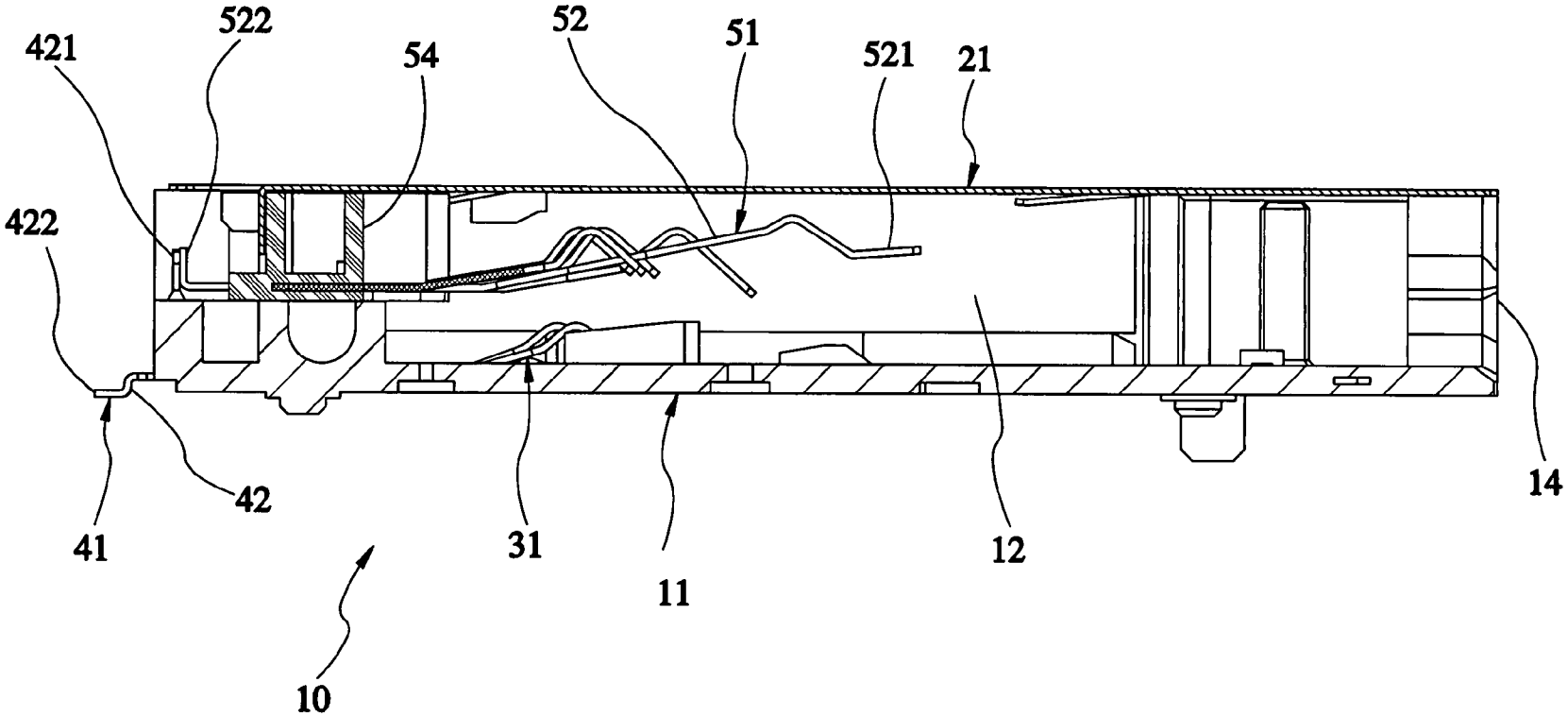
FIG. 4 is a sectional view of the preferred embodiment of the present invention.

Referring to FIGS. 1-4, an all-in-one card connector 10 constructed according to a preferred embodiment of the present invention is composed of a base frame 11, a cover member 21, a first terminal set 31, a bridge piece set 41, and a second terminal set 51.

The cover member 21 is mounted onto the base frame 11. A card chamber 12 is formed between the base frame 11 and the cover member 21. Respective front ends of the base frame 11 and the cover member 21 jointly define an entrance 14 for entry of an inserted card.

The first terminal set 31 is formed of a plurality of first terminals 32. Each of the first terminals 32 includes a molding part embedded in the base frame 11, a front end 321 thereof extending into the card chamber 12, and a rear end 322 thereof partially exposed outside a rear end of the base frame 11.

The bridge piece set 41 is formed of a plurality of bridge pieces 42, each of which includes a molding part embedded in the base frame 11, a front end 421 thereof partially exposed outside the base frame 11, and a rear end 422 thereof exposed outside the rear end of the base frame 11 and aligned with the rear end 322 of the first terminal 32. Some of the bridge pieces 42 and first terminals 32 are alternately arranged. Each of the front ends 421 of the bridge pieces 42 is flat and perpendicular to the rear end 422, i.e. the front end 421 faces upward in this embodiment. For better illustration, the bridge pieces 42 located inside the base frame 11 are shown in dotted lines.

Figure 5:
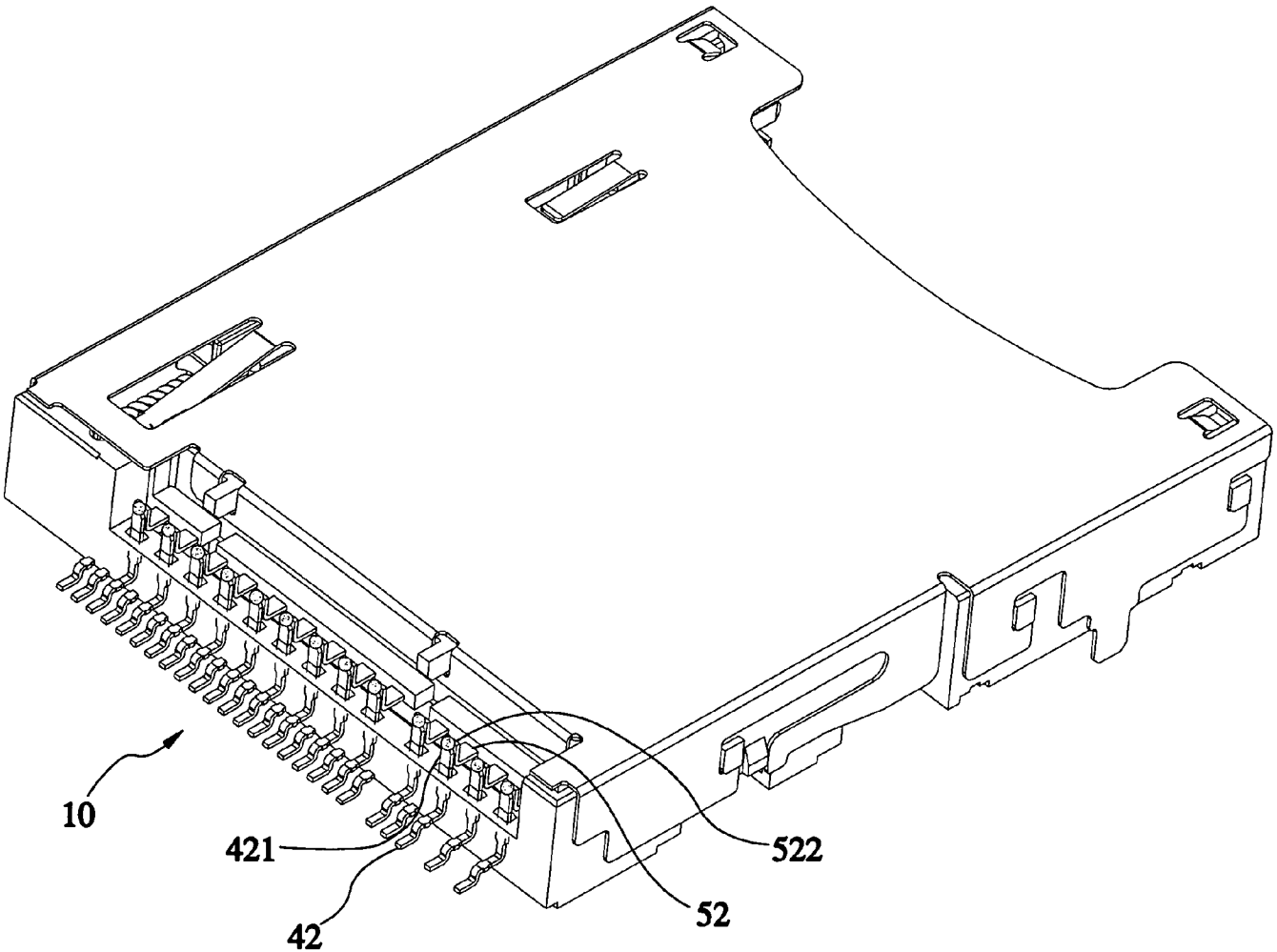
FIG. 5 is a perspective view of the preferred embodiment of the present invention to which that the solder is applied.

The second terminal set 51 is formed of a plurality of second terminals 52 mounted to a terminal rack 54 mounted to the base frame 11. Each of the second terminals 52 includes a front end 521 extending into the card chamber 12. Each of the second terminals 52 further includes a vertically flat rear end 522 having a part exposed outside a rear end of the terminal rack 54 and contacting one of the front ends 421 of the bridge pieces 42. In this embodiment, the rear ends 522 of the second terminals 52 face upward and contact the front ends 421 of the bridge pieces 42 respectively in flat lap joint. As shown in FIG. 5, the rear ends 522 are welded with the front ends 421 in this embodiment by solder balls located on top ends of the bridge pieces 42 respectively. Besides, the rear ends 522 and the front ends 421 can alternatively be welded with each other by laser welding, not limited to the soldering.

In light of the above, the bridge piece set 41 and the first terminal set 31 are molded in the base frame 11, the insert mold enables that the rear ends 422 are aligned with the rear ends 322. After the terminal rack 54 is mounted to the base frame 11, the rear ends 522 of the second terminals 52 and the front ends 421 of the bridge pieces 42 contact and then be connected by welding.

In conclusion, the bridge piece set 41 and the first terminal set 31 are formed at the base frame 11 by the insert mold and the second terminal set 51 is welded with the bridge piece set 41, such that the two terminal sets can be easily positioned while applied with the insert mold. Therefore, the present invention can be enabled and manufactured easier than the prior art to be cost-effective.

Although the present invention has been described with respect to a specific preferred embodiment thereof, it is no way limited to the details of the illustrated structures but changes and modifications may be made within the scope of the appended claims.

What is claimed is:

1. An all-in-one card connector comprising:

a base frame;

a cover member mounted onto said base frame, said cover member and said base frame jointly forming a card chamber therebetween, respective front ends of said base frame and cover member jointly defining an entrance by;

a first terminal set formed of a plurality of first terminals, each of said first terminals having a molding part embedded in said base frame, a front end extending into said card chamber, and a rear end partially exposed outside a rear end of said base frame;

a bridge piece set formed of a plurality of bridge pieces, each of said bridge pieces having a molding part embedded in said base frame, a front end partially exposed outside said base frame, and a rear end partially exposed outside the rear end of said base frame; and a second terminal set formed of a plurality of second terminals and mounted to a terminal rack, said terminal rack being mounted to said base frame, each of said second terminals having a front end extending into said card chamber and a rear end thereof partially exposed outside a rear end of said terminal rack and contacting the front end of one of said bridge pieces.

2. The all-in-one card connector as defined in claim 1, wherein the rear ends of said bridge pieces are aligned with the rear ends of said first terminals.

3. The all-in-one card connector as defined in claim 1, wherein some of said bridge pieces and said first terminals are alternately arranged.

4. The all-in-one card connector as defined in claim 1, wherein the rear ends of said second terminals are welded with the front ends of said bridge pieces respectively.

5. The all-in-one card connector as defined in claim 1, wherein the front ends of said bridge pieces and the rear ends of said second terminals are vertically flat and contact in flat lap joint.

6. The all-in-one card connector as defined in claim 5, wherein the front ends of said bridge pieces face upward; the rear ends of said second terminals face upward.

* * * * *